US006860310B2

(12) United States Patent
Kubly et al.

(10) Patent No.: US 6,860,310 B2
(45) Date of Patent: Mar. 1, 2005

(54) ROLL-UP CURTAIN ASSEMBLY

(75) Inventors: Larry J. Kubly, 606 N. Franklin St., Edgewood, IA (US) 52042; Richard P. Schmeizer, Garnavillo, IA (US)

(73) Assignees: Larry J. Kubly, Edgewood, IA (US); Richard P. Schmelzer, Garnavillo, IA (US)

( * ) Notice: Subject to any disclaimer, the term of this patent is extended or adjusted under 35 U.S.C. 154(b) by 41 days.

(21) Appl. No.: 10/294,737

(22) Filed: Nov. 14, 2002

(65) Prior Publication Data

US 2004/0094273 A1 May 20, 2004

(51) Int. Cl.[7] ..... E06B 9/08
(52) U.S. Cl. ..... 160/122; 160/243
(58) Field of Search ..... 160/243, 242, 160/246, 122, 120, 121.1

(56) References Cited

U.S. PATENT DOCUMENTS

| | | | | |
|---|---|---|---|---|
| 1,742,094 A | | 12/1929 | Perks et al. | 160/243 |
| 2,300,024 A | * | 10/1942 | Terrell | 160/238 |
| 2,564,208 A | | 8/1951 | Michelman | 160/9 |
| 2,839,135 A | | 6/1958 | Anderson | 160/133 |
| 3,180,401 A | | 4/1965 | Gambon et al. | 160/265 |
| 3,211,211 A | | 10/1965 | Youngs | 160/243 |
| 3,306,344 A | * | 2/1967 | Youngs | 160/241 |
| 3,460,602 A | * | 8/1969 | Hugus | 160/265 |
| 3,464,480 A | * | 9/1969 | Kuss | 160/368.1 |
| 4,478,268 A | | 10/1984 | Palmer | 160/310 |
| 5,520,236 A | * | 5/1996 | Thomas et al. | 160/120 |
| 5,680,893 A | | 10/1997 | Neer | 160/330 |
| 5,890,240 A | | 4/1999 | Graham | 4/502 |
| 5,911,467 A | * | 6/1999 | Evans et al. | 296/186.2 |
| 6,612,359 B1 | * | 9/2003 | Moreau | 160/120 |

FOREIGN PATENT DOCUMENTS

DE 2260348 * 6/1974

* cited by examiner

*Primary Examiner*—Blair M. Johnson
(74) *Attorney, Agent, or Firm*—Emrich & Dithmar

(57) ABSTRACT

A roll-up curtain assembly includes plural, vertically spaced, horizontal roll-up rods extending across an opening. Each roll-up rod is coupled to a respective flexible curtain section and an electric motor. Actuation of the electric motor in a first direction of rotation causes rotation of the roll-up rod in a first direction for rolling the flexible curtain section onto the rod and moving the curtain assembly to the retracted, or open, position. Actuation of the electric motor in a second, opposed direction of rotation lowers the roll-up rod resulting in an unwinding of the curtain section from the rod allowing the curtain assembly to assume the extended, or closed, position. Plural vertically spaced curtain sections each having a respective motor/roll-up rod combination are coupled together and move upward or downward in unison.

26 Claims, 6 Drawing Sheets

ROLL-UP CURTAIN ASSEMBLY

FIELD OF THE INVENTION

This invention relates generally to movable partitions or walls such as in a building structure and is particularly directed to a multi-section roll-up curtain assembly.

BACKGROUND OF THE INVENTION

Flexible doors of the general type wherein a drive mechanism for raising and lowering the door includes an electrically powered motor which applies torque to a roller causing the door to wind up on or to unwind from the roller in positioning the door in either the open or closed position, or any position therebetween. The flexible curtain is typically comprised of a lightweight, strong fabric material and the electric motor is typically connected to the roller mechanism via a reduction gear to reduce the number of revolutions of the electric motor per unit distance of travel of the flexible door. Movable structures of this type can be used either to cover an opening, such as a doorway in a building structure, or they be used as a movable partition, or curtain, in the structure.

When used as a partition, or curtain, this roll-up structure may span large distances in the building structure. These types of flexible curtains isolate the inside of the building structure from the elements, such as wind, rain, snow and sunlight, while permitting the building structure to be opened up so as to provide access to the outside when the environment is more hospitable.

As the applications for these types of flexible curtains have increased, additional demands have been placed on their structure and operation. For example, these types of flexible curtains are being used to span increasingly longer distances within the building structure. This, of course, places increasing demands upon the curtain support and drive, or displacement, system. Higher power ratings are required for the curtain drive mechanism, which typically includes an electrically powered motor, for increasing heights and horizontal distances spanned by the curtain. In addition, the curtain support system, which typically is in the form of a horizontal, elongated rod, must be stronger to accommodate the increased weight of curtains spanning larger openings and must itself be lightweight to compensate for the increased weight of the curtain. This further increases the power requirements to operate the flexible curtain. Where a roll-up rod is attached to a lower end of the flexible curtain, a complicated displacement and support mechanism is typically required to accommodate vertical movement of the rod.

The present invention addresses the aforementioned limitations of the prior art by providing a multi-section roll-up curtain assembly including plural, vertically spaced, horizontal roll-up rods each extending across an opening and attached to a respective section of the curtain. Each of the rods is coupled to and rotated by a respective electric motor, with the electric motors connected and vertically displaced with the curtain either upward or downward in retracting or extending the curtain sections in unison.

OBJECTS AND SUMMARY OF THE INVENTION

Accordingly, it is an object of the present invention to provide a multi-section roll-up curtain for use as a partition or wall in a building structure which is capable of spanning a large distance.

It is another object of the present invention to provide a multi-section roll-up curtain including plural bi-directional drive motors coupled together and arranged in a vertically spaced manner, with each motor coupled to a respective curtain section to permit the motors and curtain sections to move upward or downward in unison in opening or closing the curtain.

Yet another object of the present invention is to reduce the power required to operate a large roll-up curtain covering a large horizontal span and height.

A further object of the present invention is to incorporate plural vertically spaced, elongated horizontal members in a roll-up curtain to strengthen the curtain and make it more resistant to wind damage without increasing the power required to open and close the curtain.

The present invention contemplates a roll-up curtain comprising a first curtain section including a first fixed upper rod attached to a support structure and a second lower rod; a second curtain section in vertical alignment with the first curtain section and including a third fixed upper rod attached to the support structure and a fourth lower rod, wherein the second curtain section is disposed below the first curtain section; a first rotary drive coupled to the second lower rod for rotationally displacing the second lower rod in a first direction for rolling up the first curtain section onto the second lower rod, wherein the second lower rod is displaced upward toward first fixed upper rod in opening the first curtain section, or for rotationally displacing the second lower rod in a second opposed direction for unrolling the first curtain section from the second lower rod in closing the first curtain section; a second rotary drive disposed below the first rotary drive and coupled to the fourth lower rod for rotationally displacing the fourth lower rod in a first direction for rolling up the second curtain section onto the fourth lower rod, wherein the fourth lower rod is displaced upward toward the third fixed upper rod in opening the second curtain section, or for rotationally displacing the fourth lower rod in a second opposed direction for unrolling the second curtain section from the fourth lower rod in closing the second curtain section; and a coupling arrangement for connecting the first and second rotary drives wherein the first and second rotary drives move upward in unison when the second and fourth lower rods are displaced upward in opening the first and second curtain sections, and wherein the first and second rotary drives move downward in unison when the second and fourth lower rods are displaced downward in closing the first and second curtain sections.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
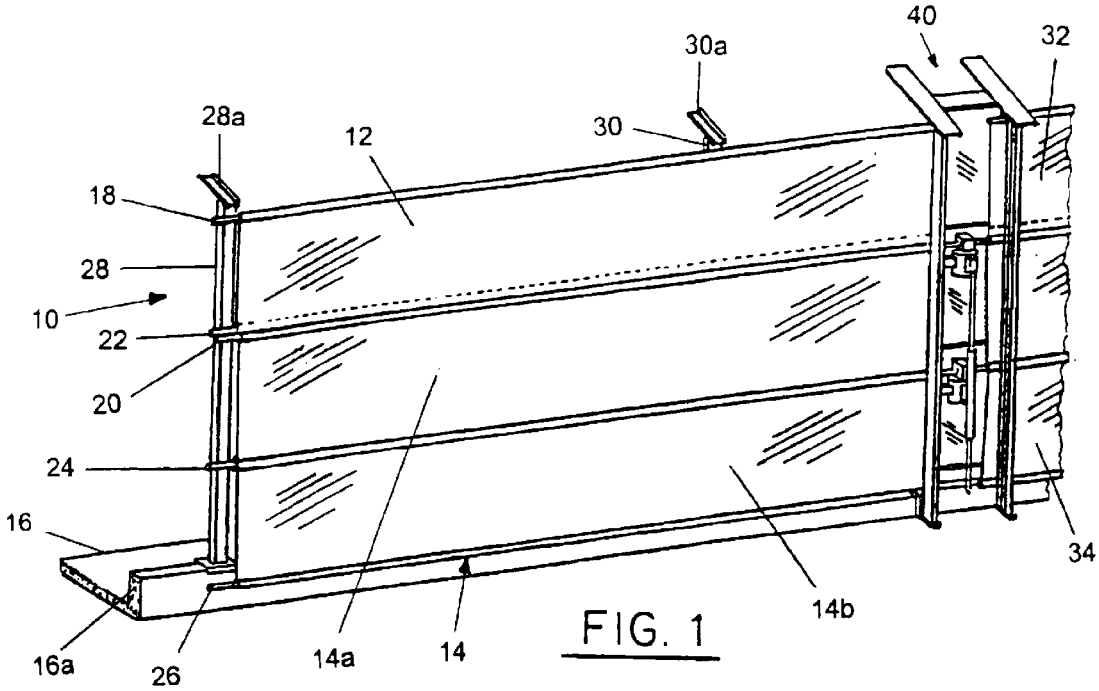
FIG. 1 is a perspective view of a roll-up curtain assembly in accordance with the present invention shown in the full closed position.
Figure 2:
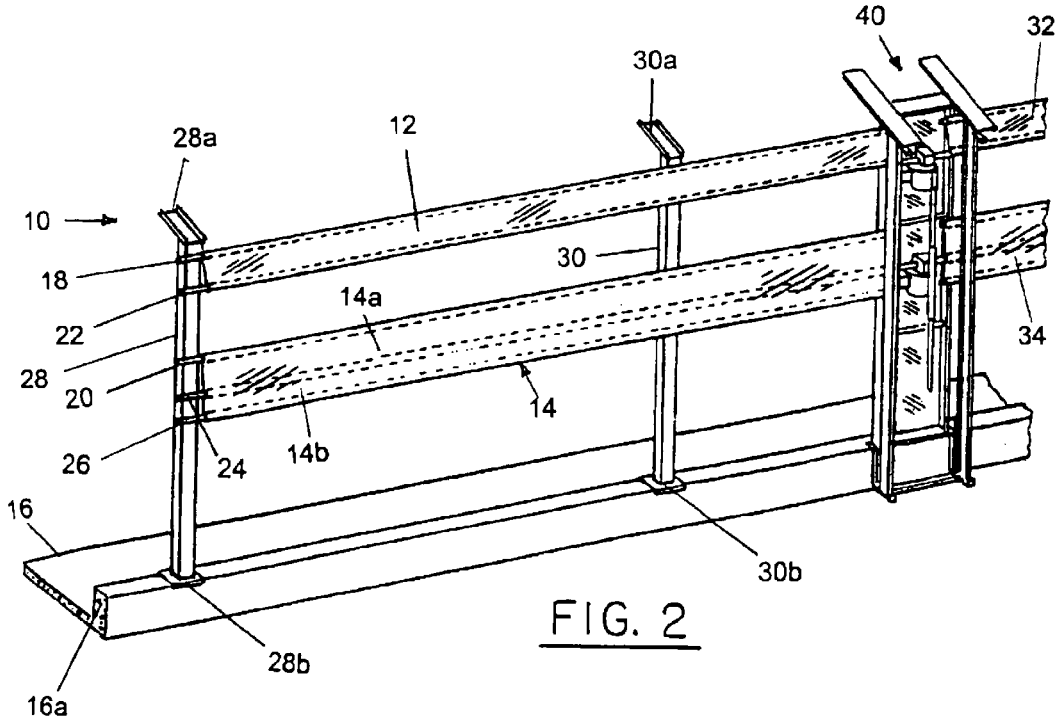
FIG. 2 is a perspective view showing the roll-up curtain assembly of FIG. 1 in a partially open position.

Referring to FIG. 1, there is shown a perspective view of a roll-up curtain assembly 10 in accordance with the present invention shown in the extended, or closed, position. FIG. 2 is a perspective view of the inventive roll-up curtain assembly 10 in the retracted, or upraised, position.

The roll-up curtain assembly 10 includes an upper curtain 12 and a lower curtain 14. The upper and lower curtains 12, 14 are connected to and supported by first and second spaced support columns 28 and 30. The first and second support columns 28, 30 respectively include upper mounting brackets 28*a* and 30*a* for attaching the support columns to upper frame members in the building structure within which the roll-up curtain assembly 10 is installed. The first and second support columns 28, 30 are also provided with respective lower mounting brackets, 28*b* and 30*b* for attaching the support columns to an upward extending edge 16*a* of the building structure's base, or floor, 16. The building structure itself within which the roll-up curtain assembly 10 is installed is not shown in the figures for simplicity.

Respective upper edges of the upper and lower curtains 12, 14 are each provided with a hem. Inserted within the upper hem of the upper curtain 12 is a first rod 18, while inserted through the upper hem of the lower curtain 14 is a second rod 20. Each of the first and second rods 18, 20 is fixedly coupled to the first and second curtain support columns 28 and 30 by conventional means such as mounting brackets which are described below. The lower edge of the upper curtain 12 is also provided with a hem in which is inserted a third rod 22. Similarly, an intermediate portion of the lower curtain 14 is provided with a hem into which is inserted a fourth rod 24. Finally, the lower edge of the lower curtain 14 is provided with a hem into which is inserted a fifth rod 26. Each of the rods is preferably comprised of a high strength, lightweight material such as aluminum or plastic and extends the full length of the curtain within which it is disposed. In addition each of the rods is preferably in the form of a hollow tube to reduce its weight. In the embodiment shown in FIGS. 1 and 2, the lower curtain 14 includes an upper section 14*a* disposed between the second and fourth rods 20, 24 and a lower section 14*b* disposed between the fourth rod and the fifth rod 26. However, this invention is not limited to this configuration, as both curtains may include only a single section, both curtains may include plural sections, or the roll-up curtain assembly may include more than two vertically aligned roll-up curtains in accordance with the principles of the present invention.

Figure 3:
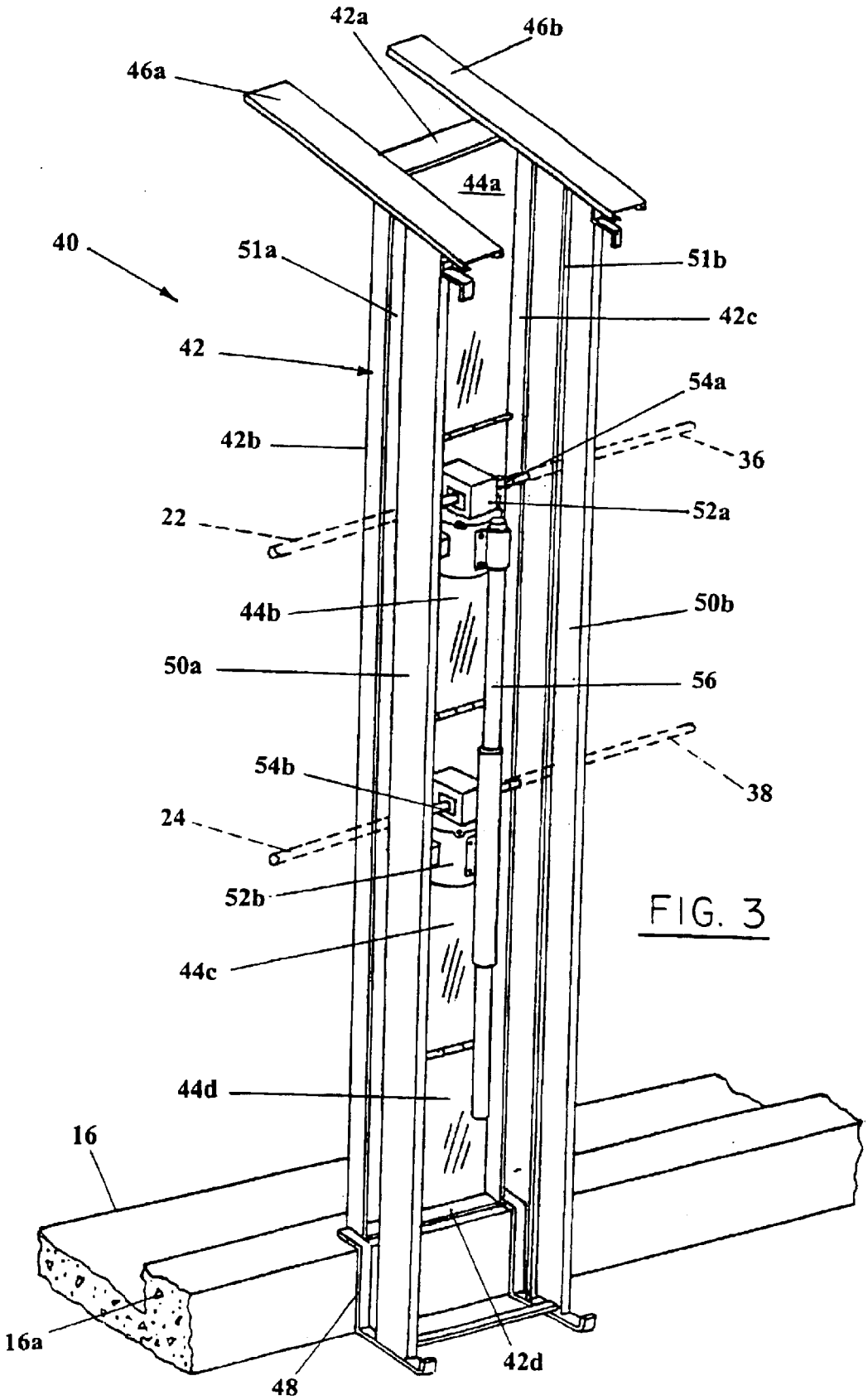
FIG. 3 is a perspective view of a support and drive arrangement for raising and lowering the roll-up curtain assembly of the present invention.

The ends of each of the upper and lower curtains 12, 14 are further connected to a support-drive mechanism 40 which is shown in greater detail in the perspective view of FIG. 3. Support/drive mechanism 40 includes a support frame 42 comprised of first and second vertical side frame members 42*b* and 42*c* and an upper frame member 42*a* connecting the upper ends of the side frame members. A lower frame member 42*d* connects adjacent lower ends of the first and second side frame members 42*b*, 42*c*. Support/drive mechanism 40 further includes third and fourth side frame members 50*a* and 50*b* disposed adjacent to and spaced from the first and second side frame members 42*b* and 42*c*, respectively. The space between the first and third side frame members 42*b*, 50*a* forms a first retainer slot 51*a*, while the space between the second and fourth side frame members 42*c* and 50*b* forms a second retainer slot 51*b*. Disposed within the first retainer slot 51 a are respective ends of the third rod 22 and the fourth rod 24 (shown in dotted line form in FIG. 3). Inserted through the second retainer slot 51*b* are sixth and seventh rods 36 and 38 also shown in dotted line form in FIG. 3. The sixth and seventh rods 36, 38 are respectively coupled to adjacent upper and lower curtains 32 and 34 which are not shown in FIG. 3 for simplicity, but are shown in FIGS. 1 and 2. Each of the aforementioned rods is freely movable within its associated retainer slot as the upper and lower curtains are displaced upwardly or downwardly within the support frame 42 as described in the following paragraphs. First, second, third and fourth cover panels 44*a*, 44*b*, 44*c* and 44*d* extend between and are coupled to the first and second side frame members 42*b* and 42*c*. A first upper mounting bracket 46*a* is coupled to respective upper ends of first side frame member 42*b* and third side frame member 58*a*. Similarly, a second upper mounting bracket 46*b* is connected to respective upper ends of second side frame member 42*c* and fourth side frame member 50*b*. The first and second upper mounting brackets 46*a*, 46*b* are further coupled to the upper frame member 42*a* of the frame support 42 and facilitate attaching the support/drive mechanism 40 to an upper portion of the building structure within which the roll-up curtain assembly is installed.

Attached to adjacent ends of third rod 22 and sixth rod 36 by means of a first drive shaft 54*a* is an upper motor/gearbox combination 52*a*. Similarly, attached to adjacent ends of fourth rod 24 and seventh rod 38 by means of a second drive shaft 54*b* is a lower motor/gearbox combination 52*b*. Rotation of the third rod 22 by the upper motor/gearbox combination 52*a* causes the upper curtain 12 to be either rolled-up unto or unrolled from the third rod in raising or lowering the upper curtain. Similarly, rotation of the fourth rod 24 by means of the lower motor/gearbox combination 52*b* causes the lower curtain 14 to be rolled-up on or unrolled from the fourth rod. Similarly, rotation of the sixth rod 36 by means of the upper motor/gearbox combination 52*a* and rotation of the seventh rod 38 by means of the lower motor/gearbox combination 52*b* causes respective curtains attached to these rods to be either retracted or extended. The upper and lower motor/gearbox combinations 52*a*, 52*b* are coupled by means of connecting bar 56 so that the two motor/gearbox combinations and rods connected thereto move in unison either upward in rolling the curtain section up to the retracted position or downward in unrolling the curtain sections from the supporting rods and moving the curtain to the fully extended, or closed, position.

Figure 4:
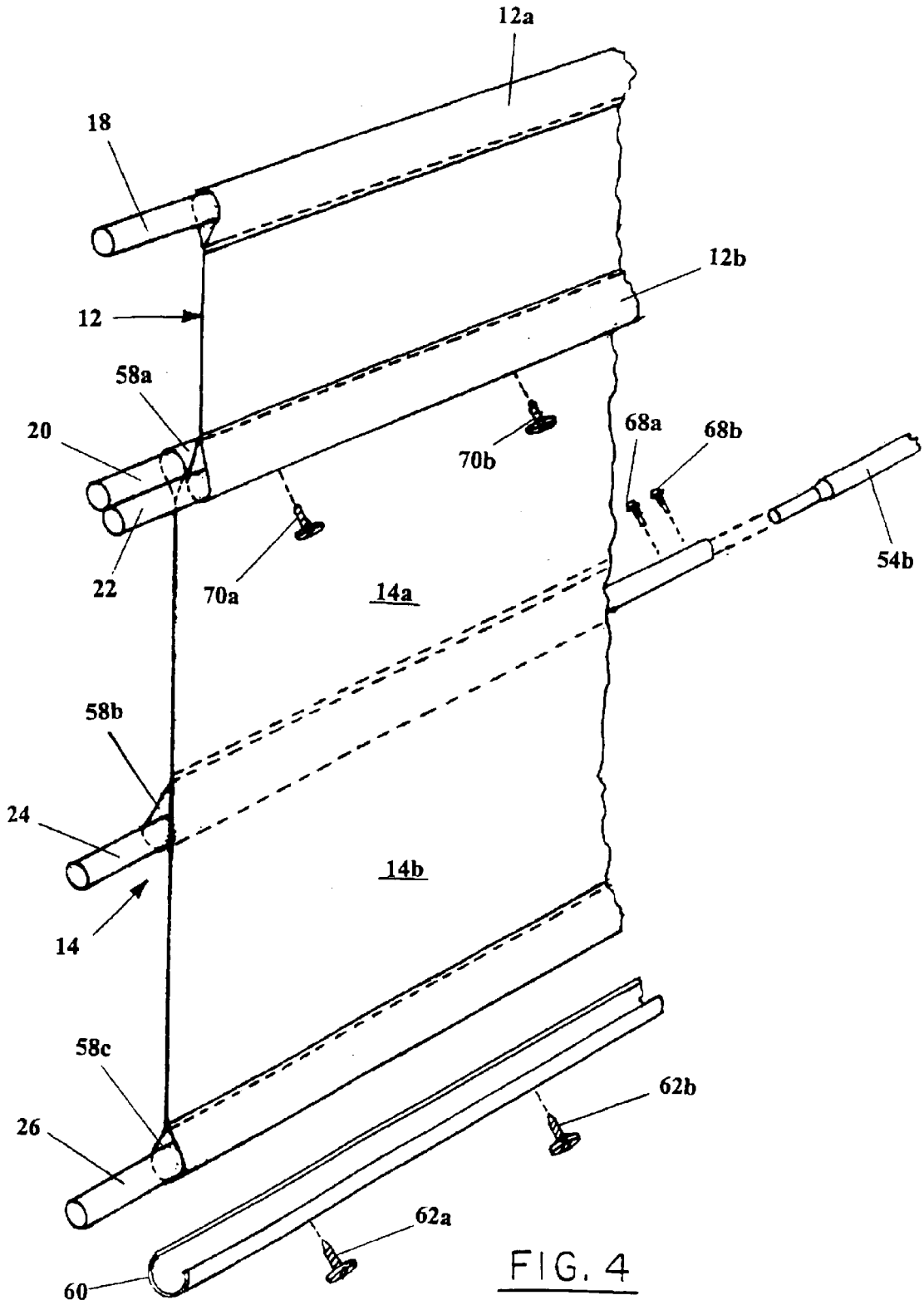
FIG. 4 is a partial perspective view of plural curtain sections of a roll-up curtain assembly in accordance with one embodiment the present invention.

Additional details of the roll-up curtain is shown in the partial perspective view of FIG. 4. As previously described, the upper curtain 12 includes an upper hem 12*a* within which is inserted the first rod 18. Upper curtain 12 further includes a lower hem 12*b* within which is inserted the third rod 22. Similarly, lower curtain 14 includes upper, intermediate and lower hems 58*a,* 58*b* and 58*c* within which are respectively disposed the second, fourth and fifth rods 20, 24 and 26. A pair of threaded coupling pins 70*a* and 70*b* fixedly attach the third rod 22 to the lower hem 12*b* of the upper curtain 12. Thus, when the third rod 22 is rotationally displaced, the upper curtain 12 is either rolled up onto or is unrolled from the third rod. Similarly, threaded couplers are used to fixedly attach the fourth rod 24 to the intermediate hem 58*b* of the lower curtain 14 to ensure that when the fourth rod is rotationally displaced, the upper and lower sections 14*a* and 14*b* of the lower curtain 14 are either rolled up onto or unrolled from the fourth rod. Attached to the fifth rod 26 as well as to the lower hem 58*c* of the lower curtain 14 is a protective sleeve 60. Protective sleeve 60 is attached to the fifth rod 26 and the lower hem 58*c* by means of threaded coupling pins 62*a* and 62*b*. Protective sleeve 60 is preferably comprised of a lightweight, semi-rigid and durable material such as PVC to afford protection for the lower edge of the curtain. Also shown is the manner in which drive shaft 54*b* is securely coupled to an end of the fourth rod 24. The narrowed end of the drive shaft 54*b* is telescopically inserted in an adjacent end of the fourth rod 24 and the connection between these shafts is maintained by means of threaded coupling pins 68*a* and 68*b*. A similar connection arrangement to an upper drive shaft is provided for attaching the drive shaft to the third rod 22, but details of this connecting arrangement are not shown in FIG. 4 for simplicity.

Figure 5:
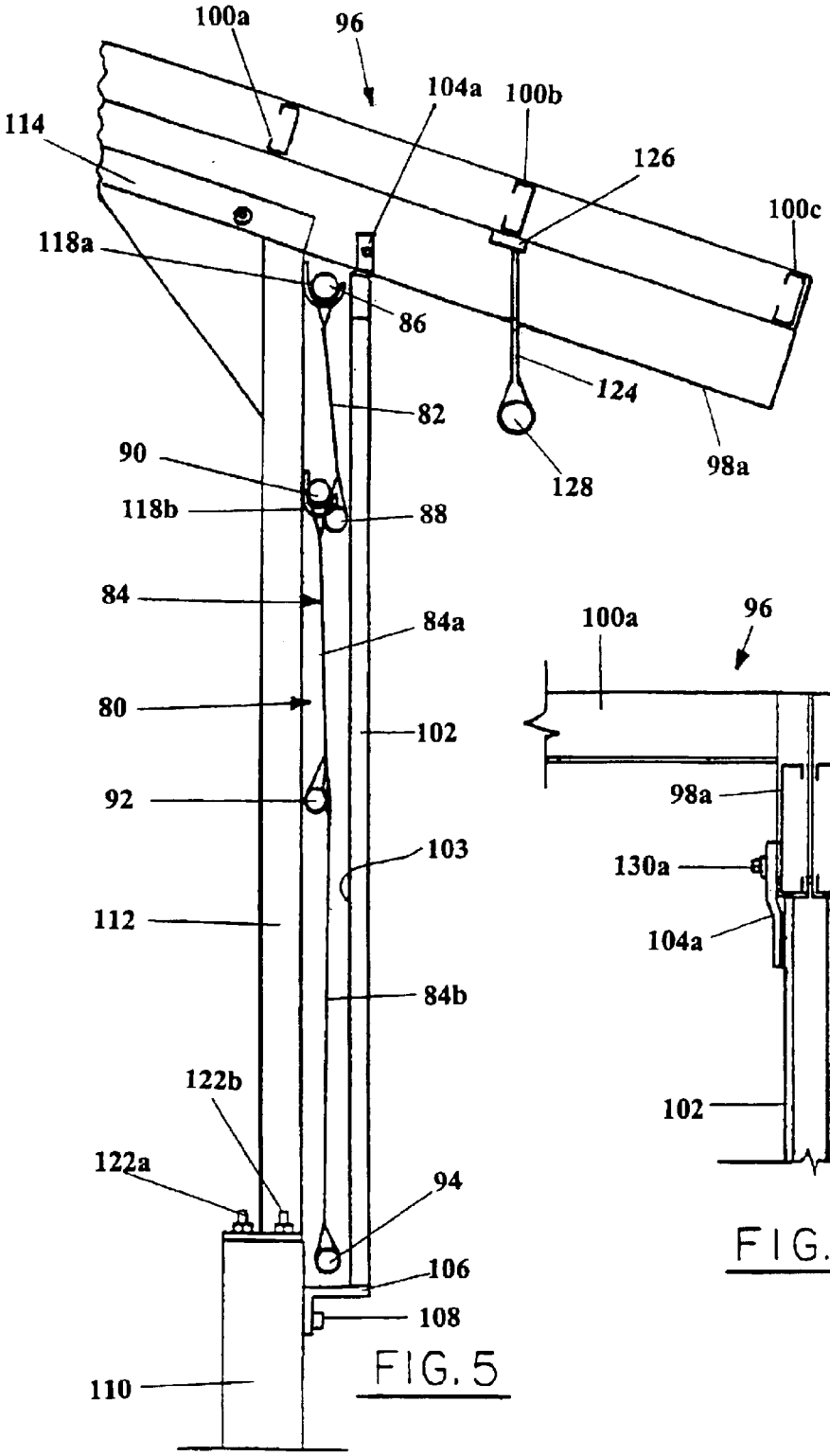
FIG. 5 is a side elevation view shown partially in section of a multi-section, roll-up curtain assembly in accordance with the present invention.

Referring to FIG. 5, there is shown a side elevation view of additional installation details of a roll-up curtain assembly 80 in accordance with the principles of the present invention. As in the previously described embodiment, roll-up curtain assembly 80 includes an upper curtain 82 and a lower curtain 84. Upper and lower edges of the upper curtain 82 are provided with respective hems, with a first rod 86 inserted in the upper curtain's upper hem and a second rod 88 inserted through the upper curtain's lower hem. Opposed ends of the first rod 86 are inserted in and supported by pipe hanger brackets 118 disposed on adjacent support frames 112. As described above, the second rod 88 is coupled to a drive mechanism for rotational displacement of the second rod in raising or lowering the upper curtain 82.

The lower curtain 84 is comprised of an upper curtain section 84*a* and a lower curtain section 84*b*. An upper edge of the upper curtain section 84*a* is provided with a hem along the length thereof into which is inserted a third rod 90. Similarly, the lower end of the lower curtain section 84*b* is provided with a hem into which is inserted a fifth rod 94. An intermediate portion of the lower curtain 84 is provided with a third hem into which is inserted a fourth rod 92. Opposed ends of the fourth rod 92 are connected to a drive mechanism for rotationally displacing the fourth rod in either raising or lowering the lower curtain 84 as previously described. Opposed ends of each of the aforementioned rods are disposed within a slot 103 formed between the support frame 112 and a curtain retainer track 102. Slot 103 maintains all of the aforementioned rods in a generally common vertical alignment during retraction and extension of the curtain as well as when the curtain is in a fixed position. A lower end of the support frame 112 is securely mounted to a concrete base 110 by means of nut and bolt combinations 122*a* and 122*b*. Similarly, a lower end of the curtain retainer track 102 is securely mounted to the concrete base 110 by means of the combination of a lower angle 106 and a mounting screw 108. Upper ends of the curtain retainer track 102 and support frame 112 are securely attached to a roof structure 96 by means of respective first and second upper mounting brackets 104 and 114. Roof section 96 includes plural spaced rafters 98*a* and 98*b* as shown in the partial sectional view of FIG. 6 and plural spaced purlins 100*a,* 100*b* and 100*c* as shown in FIG. 5. An optional fixed curtain 124 may be attached to the second purlin 100*b* by means of a mounting bracket 106. A lower edge of the fixed curtain 124 is provided with a hem for receiving a sixth rod 128 which maintains the fixed curtain in a vertical, stretched configuration as shown in FIG. 5.

Figure 6:
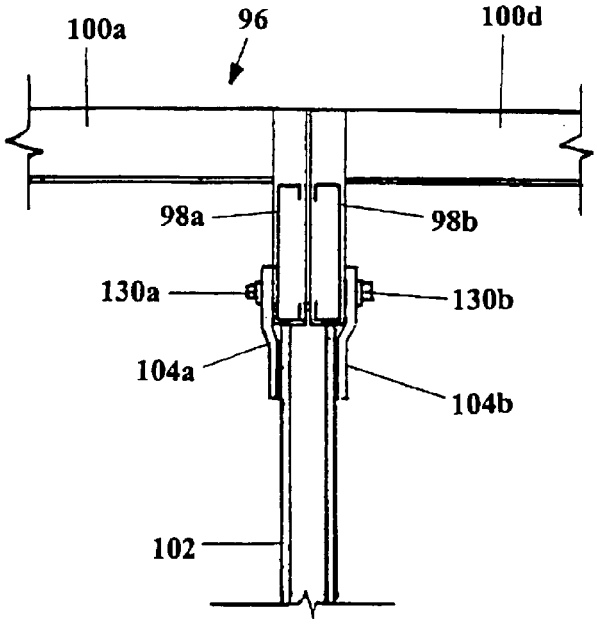
FIG. 6 is a partial sectional view of a portion of a support structure for use with the roll-up curtain assembly of the present invention.

Additional details of the manner in which an upper end of the curtain retainer track 102 is securely attached to the roof structure 96 are shown in FIG. 6. Disposed on opposed sides of the curtain retainer track 102 and attached to the upper edge thereof by conventional means such as a glue or cement composition are the aforementioned upper mounting bracket 104*a* and a second upper mounting bracket 104*b*. Upper mounting brackets, or straps, 104*a,* 104*b* are also attached to a pair of side-by-side roof rafters 98*a* and 98*b*. A first mounting screw 130*a* is inserted through upper mounting bracket 104*a* and roof rafter 98*a* for connecting these members, while a second mounting screw 130*b* is inserted through upper mounting bracket 104*b* and roof rafter 98*b* for securely connecting these structural members. Upper portions of the roof rafters 98*a,* 98*b,* which each have a generally C-shaped cross section, are connected to roof purlin 100*a* by conventional means such as connecting screws or brackets, which are not shown in the figure for simplicity.

Figure 7:
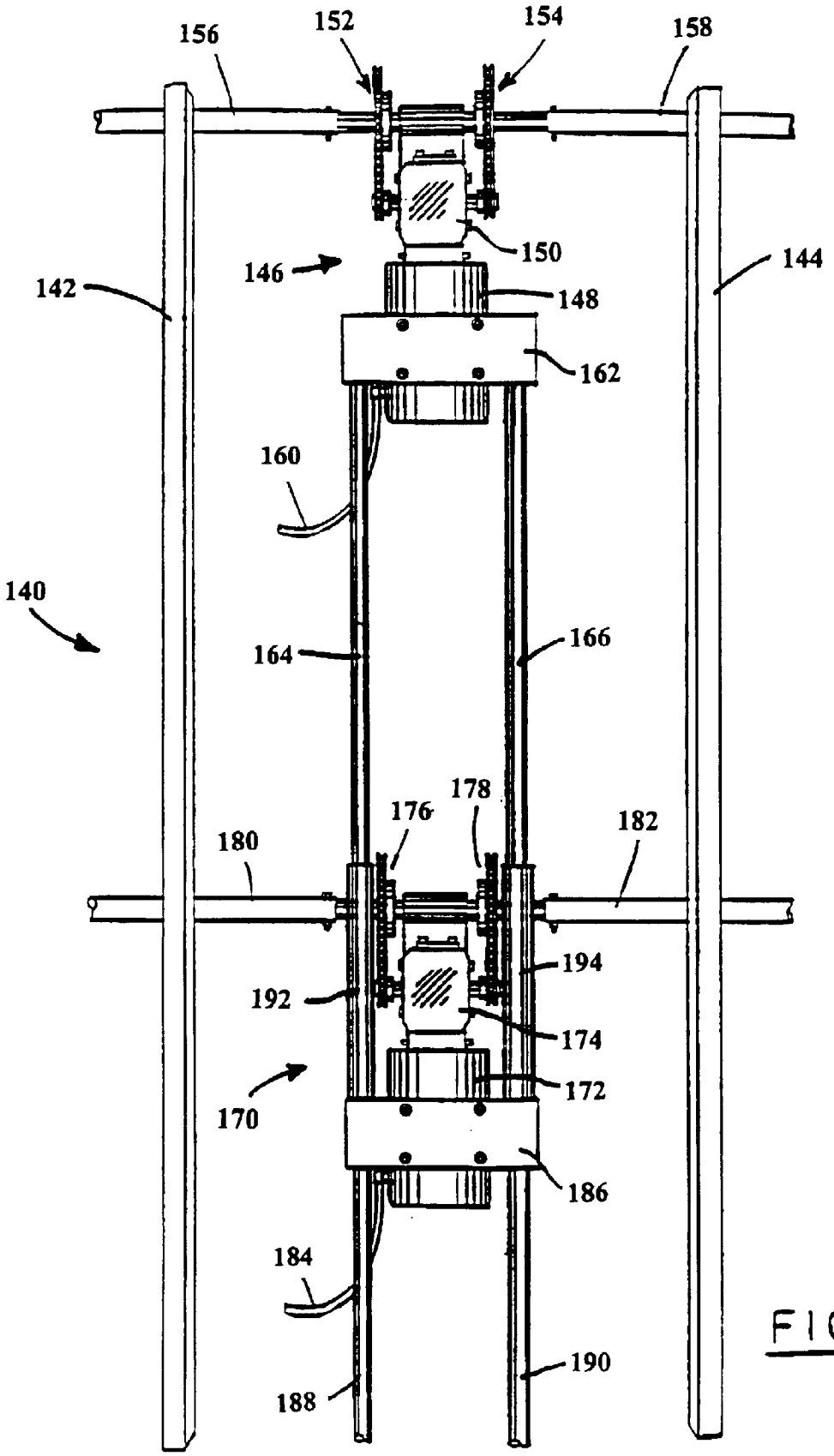
FIG. 7 is a plan view of a pair of drive motors each connected to a respective moveable support rod attached to a respective curtain section for raising and lowering the curtain sections in unison.
Figure 8:
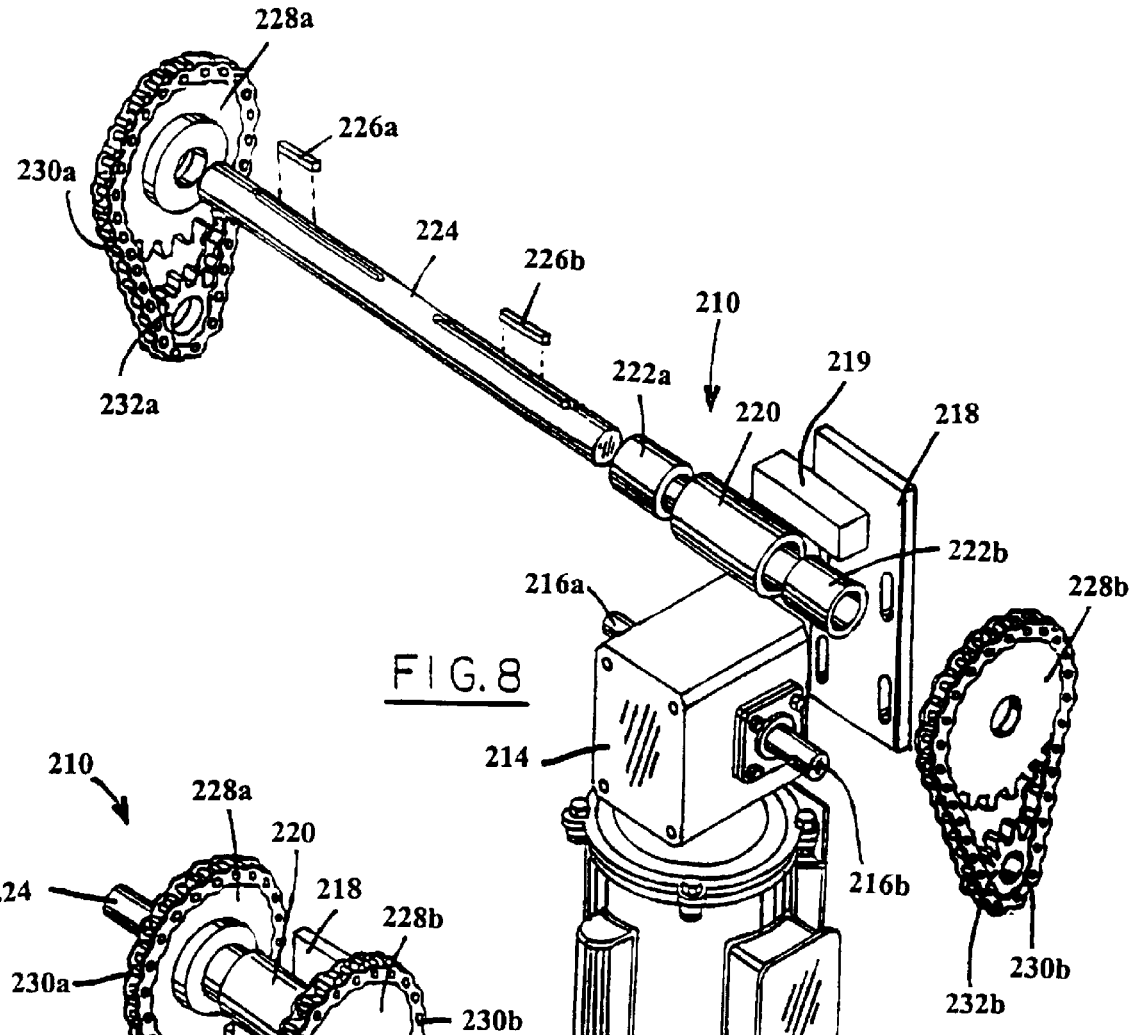
FIGS. 8 and 9 are respectively exploded and perspective views of a drive mechanism for raising and lowering a roll-up curtain assembly in accordance with one aspect of the present invention.
Figure 9:
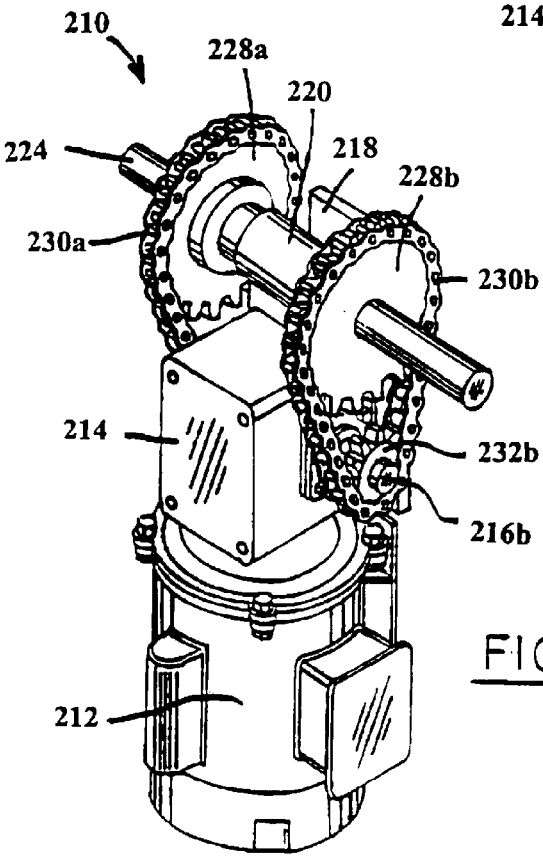

Referring to FIG. 7 there is shown a plan view of another embodiment of a curtain drive mechanism 140 in accordance with the principles of the present invention. FIGS. 8 and 9 are respectively exploded and assembled perspective views of a double reduction drive mechanism 210 employed in the curtain drive mechanism 140 of FIG. 7.

Curtain drive mechanism 140 includes an upper double reduction drive mechanism 146 and a lower double reduction drive mechanism 170. Upper double reduction drive mechanism 146 includes a first electric motor 148, a first gearbox 150, and first and second paired sprockets, or tooth gears, 152 and 154. The first paired sprockets 152 are connected to and rotationally drive a first drive rod 156 while the second paired sprockets 154 are coupled to and rotationally displace a second drive rod 158. The first drive rod 156 is disposed in a first vertical slot formed by a first curtain retainer track 142 and a first support frame (not shown), while the second drive rod 158 is disposed in a second vertical slot formed by a second curtain retainer track 144 and a second support frame (also not shown). The first and second drive rods 156, 158 are displaced vertically within a respective slot by operation of the upper and lower double reduction drive mechanisms 146, 170 as in the previously described embodiment. An electrical lead 160 is coupled to and provides input power to the first electric motor 148.

The lower double reduction drive mechanism 170 similarly includes a second electric motor 172, a second gearbox 174, and third and fourth paired sprockets 176 and 178. The third paired sprockets 176 are coupled to and rotationally displace a third drive rod 180, while the fourth paired sprockets 178 are coupled to and rotationally displace a fourth drive rod 182. An electrical lead 184 is connected to and provides input power to the second electric motor 172. Each of the third and fourth drive rods 180, 182 is inserted in a respective slot formed partially by the first and second curtain retainer tracks 142, 144 and are displaced vertically within the slots by operation of the second electric motor 172.

The upper and lower double reduction drive mechanisms 146 and 170 move vertically in unison because they are connected together in the following manner. Attached to the first electric motor 148 by plural connecting pins such as screws is a first mounting plate 162. Similarly, attached to the second electric motor 172 by plural connecting pins is a second mounting plate 186. The first mounting plate 162 is connected to respective upper ends of first and second connecting shafts 164 and 166, while the second mounting plate 186 is coupled to respective upper ends of third and fourth connecting shafts 188 and 190. Each of the aforementioned shafts is connected to a respective mounting plate by conventional means such as a threaded connecting pins and a mounting bracket which are not shown in the figure for simplicity. Coupling the lower end of the first connecting shaft 164 to the upper end of the third connecting shaft 188 is a first connecting rod 192 while connecting the lower end of the second connecting shaft 166 to the upper end of the fourth connecting shaft 190 is a second connecting rod 194. Each of the aforementioned first and second connecting rods 192, 194 is coupled to a pair of connecting shafts by conventional means such as a set screw or connecting pin (also not shown for simplicity). By thus connecting the upper and lower double reduction drive mechanisms 146 and 170, the two drive mechanisms move upwardly and downwardly in unison and upper and lower curtains respectively attached to the upper and lower double reduction drive mechanism also move upwardly and downwardly towards the open and closed positions, respectively, in unison.

Referring to FIGS. 8 and 9, the details of the configuration and operation of each of the double reduction drive mechanisms will now be described. Shown in FIGS. 8 and 9 respectively in exploded and assembled perspective views is a double reduction drive mechanism 210 as used in one embodiment of the present invention. Double reduction drive mechanism 210 allows larger curtain spans and heights to be accommodated without increasing the input power required to move the curtains between the open and closed positions by increasing the torque applied to the curtain sections. In addition, the double reduction drive mechanism decreases the speed of the curtains being raised or lowered without increasing the speed or power of the drive motor.

Double reduction mechanism 210 includes an electric motor 212 connected to a gearbox 214. Gearbox 214 changes the drive axis from a generally vertical orientation to a horizontal orientation as evidenced by the position of the first and second drive shafts 216*a* and 216*b* extending from an upper portion of the gearbox. The first and second drive shafts 216*a*, 216*b* are respectively inserted within an aperture of and connected to first and second drive sprockets 232*a* and 232*b*. The first and second drive sprockets 232*a*, 232*b* are coupled to the first and second drive shafts 216*a*, 216*b*, respectively, by conventional means such as a shaft keyed or a threaded set screw. Engaging the first and second drive sprockets 232*a* and 232*b* are first and second roller drive chains 230*a* and 230*b*, respectively. The first drive chain 230*a* further engages the teeth of a first driven sprocket 228*a*, while the second drive chain 230*b* engages the teeth of a second driven sprocket 228*b*. Each of the first and second driven sprockets 228*a*, 228*b* includes a respective aperture within which is inserted a respective end of a connecting rod 224. Connecting rod 224 is inserted through aligned first and second brass bushings 222*a* and 222*b* and a spacer rod 220 disposed between the brass bushings. The first and second brass bushings 220*a*, 220*b* and the spacer rod 220 are maintained in fixed, spaced position along the length of the connecting rod 224 by means of first and second locking keys 226*a* and 226*b* inserted in respective slots in the connecting rod. Rotation of the drive shafts 216*a* and 216*b* in a first direction causes a corresponding rotation of the drive chains 230*a*, 230*b*, the driven sprockets 228*a*, 228*b* and the connecting rod 224, while rotation of the drive shafts in a second, opposed direction results in reverse rotation of the aforementioned components of the double reduction drive mechanism 210 which are connected to the drive shaft. It is in this manner that the rods which are connected to the connecting rod 224 as well as to a curtain section either roll-up or unroll the curtain section.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A roll-up curtain comprising:

a first curtain section including a first fixed upper rod attached to a support structure and a third lower rod;

a second curtain section in vertical alignment with said first curtain section and including a second fixed upper rod attached to the support structure and a fourth lower rod, wherein said second curtain section is disposed below said first curtain section;

first rotary drive means coupled to said third lower rod for rotationally displacing said third lower rod in a first direction for rolling up said first curtain section onto said third lower rod, wherein said third lower rod is displaced upward toward said first fixed upper rod in opening said first curtain section, or for rotationally displacing said third lower rod in a second opposed direction for unrolling said first curtain section from said third lower rod in closing said first curtain section;

second rotary drive means disposed below said first rotary drive means and coupled to said fourth lower rod for rotationally displacing said fourth lower rod in a first direction for rolling up said second curtain section onto said fourth lower rod, wherein said fourth lower rod is displaced upward toward said second fixed upper rod in opening said second curtain section, or for rotationally displacing said fourth lower rod in a second opposed direction for unrolling said second curtain section from said fourth lower rod in closing said second curtain section; and linkage means for connecting said first and second rotary drive means wherein said first and second rotary drive means move upward in unison when said third and fourth lower rods are displaced upward in opening said first and second curtain sections, and wherein said first and second rotary drive means move downward in unison when said third and fourth lower rods are displaced downward in closing said first and second curtain sections.

2. The roll-up curtain of claim 1 further comprising a support structure coupled to said first and second fixed upper rods for supporting said first and second curtain sections.

3. The roll-up curtain of claim 2 wherein each of said rods includes respective first and second opposed ends and said support structure includes a pair of spaced, generally vertical slots, wherein each slot is adapted to receive an end of each of said rods for maintaining said rods in vertical alignment.

4. The roll-up curtain of claim 3 wherein each of said first and second curtain sections includes plural spaced hems, and wherein each of said rods is disposed within a respective one of said hems of a curtain section.

5. The roll-up curtain of claim 4 wherein each of said rods and hems extends the length of a curtain section.

6. The roll-up curtain of claim 5 wherein opposed ends of said first and second upper rods are fixedly attached to said support structure.

7. The roll-up curtain of claim 6 wherein each of said rods is in the form of a thin, linear, elongated member.

8. The roll-up curtain of claim 7 wherein each of said rods is comprised of tubular structural steel.

9. The roll-up curtain of claim 1 further comprising plural connecting pins inserted through each of the lower portions of said first and second curtain sections and into said third and fourth lower rods.

10. The roll-up curtain of claim 9 wherein each of said connecting pins is a screw or nail.

11. The roll-up curtain of claim 1 wherein said third and fourth lower rods are disposed in lower edge portions of said first and second curtain sections, respectively.

12. The roll-up curtain of claim 11 further comprising a protective sleeve attached to the lower edge of said second curtain section.

13. The roll-up curtain of claim 12 wherein said protective sleeve is comprised of plastic or metal.

14. The roll-up curtain of claim 12 wherein said protective sleeve is comprised of PVC.

15. The roll-up curtain of claim 1 wherein said second curtain section includes an upper portion and a lower portion and wherein said fourth lower rod is disposed on an intermediate portion of said second curtain section between said upper and lower portions, and wherein said upper and lower portions of said second curtain section are simultaneously rolled up on or unrolled from said fourth lower rod as said second curtain section is opened or closed.

16. The roll-up curtain of claim 15 further comprising a fifth rod disposed on a lower edge of said second curtain section.

17. The roll-up curtain of claim 16 wherein each of said first and second curtain sections includes plural spaced hems, and wherein each of said rods is disposed within a respective one of said hems of a curtain section.

18. The roll-up curtain of claim 17 wherein each of said rods and hems extends the length of the curtain section within which the rod and hem combination is disposed.

19. The roll-up curtain of claim 18 wherein said first curtain section includes a lower edge, said roll-up curtain further comprising plural connecting pins inserted through each of the lower edges of said first and second curtain sections and into said third lower rod and said fifth rod.

20. The roll-up curtain of claim 19 wherein each of said connecting pins is a screw or nail.

21. The roll-up curtain of claim 1 wherein said linkage means includes an elongated, rigid, linear member connecting said first and second rotary drive means.

22. The roll-up curtain of claim 1 wherein said first and second rotary drive means respectively include first and second electric motors.

23. The roll-up curtain of claim 22 wherein said first and second rotary drive means further include first and second gearboxes respectively coupled to said first and second electric motors.

24. A roll-up curtain comprising:

a first curtain section including a first fixed upper rod attached to a support structure and a third lower rod;

a second curtain section in vertical alignment with said first curtain section and including a second fixed upper rod attached to the support structure and a fourth lower rod, wherein said second curtain section is disposed below said first curtain section;

first rotary drive means coupled to said third lower rod for rotationally displacing said third lower rod in a first direction for rolling up said first curtain section onto said third lower rod, wherein said third lower rod is displaced upward toward said first fixed upper rod in opening said first curtain section, or for rotationally displacing said third lower rod in a second opposed direction for unrolling said first curtain section from said third lower rod in closing said first curtain section; and second rotary drive means disposed below said first rotary drive means and coupled to said fourth lower rod for rotationally displacing said fourth lower rod in a first direction for rolling up said second curtain section onto said fourth lower rod, wherein said fourth lower rod is displaced upward toward said second fixed upper rod in opening said second curtain section, or for rotationally displacing said fourth lower rod in a second opposed direction for unrolling said second curtain section from said fourth lower rod in closing said second curtain section;

wherein said first and second rotary drive means are further coupled to third and fourth curtain sections, respectively, for rolling up and unrolling said third and fourth curtain sections simultaneously with said first and second curtain sections, and wherein said first and third curtain sections are disposed on opposed sides of said first rotary drive means and said second and fourth curtain sections are disposed on opposed sides of said second rotary drive means.

25. A roll-up curtain comprising;

a first curtain section including a first fixed upper rod attached to a support structure and a third lower rod;

a second curtain section in vertical alignment with said first curtain section and including a second fixed upper rod attached to the support structure and a fourth lower rod, wherein said second curtain section is disposed below said first curtain section;

first rotary drive means including a first electric motor coupled to a first gearbox, said first rotary drive means coupled to said third lower rod for rotationally displacing said third lower rod in a first direction for rolling up said first curtain section onto said third lower rod, wherein said third lower rod is displaced upward toward first fixed upper rod in opening said first curtain section, or for rotationally displacing said third lower rod in a second opposed direction for unrolling said first curtain section from said third lower rod in closing said first curtain section;

second rotary drive means including a second electric motor coupled to a second gearbox, said second rotary drive means disposed below said first rotary drive means and coupled to said fourth lower rod for rotationally displacing said fourth lower rod in a first direction for rolling up said second curtain section onto said fourth lower rod, wherein said fourth lower rod is displaced upward toward said second fixed upper rod in opening said second curtain section, or for rotationally displacing said fourth lower rod in a second opposed direction for unrolling said second curtain section from said fourth lower rod in closing said second curtain section;

said first and second rotary drive means being linked together for movement in unison; and first and second double reduction drive assemblies respectively coupling said first and second gearboxes to said third and fourth lower rods.

26. The roll-up curtain of claim 25 wherein each of said first and second double reduction drive assemblies includes a respective drive sprocket coupled to a gearbox, a respective driven sprocket coupled to a lower rod, and a respectively roller chain connecting paired drive and driven sprockets.

* * * * *